United States Patent [19]

Murfitt

[11] Patent Number: 4,560,306

[45] Date of Patent: Dec. 24, 1985

[54] COAL FACE SUPPORT

[75] Inventor: Raymond G. Murfitt, Chorley, England

[73] Assignee: Dobson Park Industries Limited, Nottingham, England

[21] Appl. No.: 482,373

[22] Filed: Apr. 5, 1983

Related U.S. Application Data

[63] Continuation of Ser. No. 204,683, Nov. 5, 1980, abandoned.

[30] Foreign Application Priority Data

Nov. 9, 1979 [GB] United Kingdom ..... 7938879

[51] Int. Cl.[4] ..... E21D 15/44

[52] U.S. Cl. ..... 405/295; 405/291

[58] Field of Search ..... 405/291, 292, 295-297, 405/300, 301; 180/8.1, 8.5; 299/31, 33

[56] References Cited

U.S. PATENT DOCUMENTS

| | | | |
|---|---|---|---|
| 2,062,657 | 12/1936 | Jay | 180/8.1 UX |
| 3,381,480 | 5/1968 | Andrews | 405/296 X |
| 3,564,857 | 2/1971 | Von Hippel | 405/296 |
| 3,603,098 | 9/1971 | Groetschel | 405/301 |
| 3,830,324 | 8/1974 | Chambers | 180/8.5 |
| 3,889,475 | 6/1975 | Allen | 405/296 X |
| 3,921,739 | 11/1975 | Rich et al. | 180/8.5 |
| 4,269,546 | 5/1981 | Saunders | 405/296 X |

FOREIGN PATENT DOCUMENTS

| | | | |
|---|---|---|---|
| 1051783 | 12/1966 | United Kingdom | 405/301 |

*Primary Examiner*—Dennis L. Taylor

*Attorney, Agent, or Firm*—Townsend and Townsend

[57] ABSTRACT

A mine roof support comprises a base formed of two base members, a beam disposed therebetween, jacks for lifting the base members or the beam one relative to the other and a jack for advancing the base member or the beam one relative to the other. A roofing bar structure is supported from the base members by extendible props and an elevated platform is disposed between the base and the roofing bar structure. The support is advanced by lifting, advancing and lowering the beam relative to the base members and then lifting, advancing and lowering the base members relative to the beam.

17 Claims, 3 Drawing Figures

COAL FACE SUPPORT

This is a continuation of application Ser. No. 204,683, filed Nov. 5, 1980 now abandoned.

This invention relates to mine roof supports, and in particular to self advancing roof supports used along a coal face. More particularly the invention relates to mine roof supports for use with high coal faces and which have an elevated, forwardly extending platform. Such a platform may extend over the coal conveyor and coal cutting machine and may also provide a mounting for a forwardly located roof supporting prop or props. Such arrangements are described in British Pat. No. 1,114,472.

One of the problems, associated with working on high coal faces in particular, is that of the large mass of each mine roof support and attached equipment creating a tendency for the support to dig into the floor as it is moved. Also 'scurfing' of the floor tends to create excessive build-up of material in front of the support. Either of these factors can hinder or prevent movement of the support towards the coal face. The problem is particularly acute in circumstances wherein the coal is soft and friable. Also in such circumstances a further problem is that of the tendency of coal to fall from the upper part of the face as coal is cut from the lower part of the face. It is an object of the present invention to provide a mine roof support which overcomes or substantially alleviates these problems.

The invention provides a mine roof support having a base comprising at least one roof supporting base member and a beam, a roofing bar structure supported from said base member or members by extendible props, and means for advancing the support comprising means adapted to lift said base member or members relative to said beam, and means adapted to more longitudinally either one of said beam and said base member or members relative to the other.

The invention also provides a mine roof support of the type having a base, comprising at least one roof supporting base member and a beam, a roofing bar structure supported from said base member or members by extendible props, means for advancing the support comprising means adapted to lift said base member or members relative to said beam, and means adapted to move longitudinally either one of said beam and said base member or members relative to the other, an elevated forwardly extending platform intermediate the base and the roofing bar structure and a vertically extending coal face support sprag located at the forward end of said elevated platform.

Preferably two roof supporting base members are provided and are linked so as to be movable together. In this case the beam is located between the base members and is guided therebetween.

By the term 'lift' it is envisaged that the lifting means are adapted to lift the base member or members completely clear of the floor or at least to a position in which the floor is contacted but there is substantially no reactive force acting between the floor and the lifted base member.

Preferably the sprag is pivotally mounted so as to compensate for the unevenness and non-verticality of a coal face, in which case an extendible arm may be connected between the platform and the sprag to adjust the inclination of the sprag.

Also the sprag pivotal mounting may be attached to a forwardly displaceable portion of the platform whereby the sprag may be moved in a fore and aft direction relative to the mine roof support and thereby contact the coal face.

The mine roof support may also have a coal face supporting sprag attached to and depending from the roofing bar structure, the depending sprag also being pivotally mounted and having an extendible arm connecting it with the roofing bar structure whereby its inclination may be adjusted.

The invention will now be further described with reference to the accompanying drawings, which illustrate one embodiment of mine roof support according to the invention:

FIGS. 2 and 3 are a plan view and a vertical section, respectively, of the base showing the roof supporting base members and the beam moved forwardly thereof.

Figure 1:
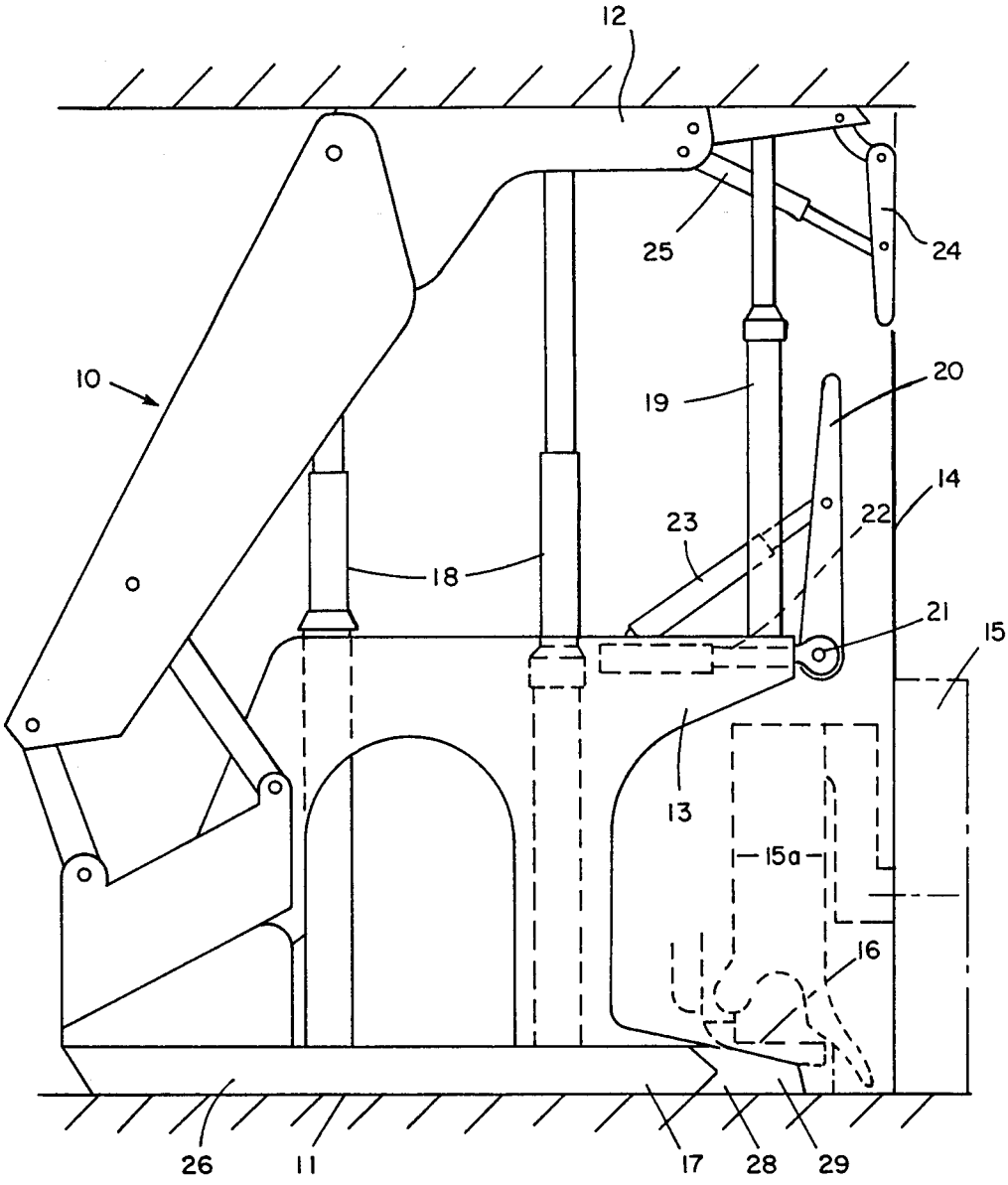
FIG. 1 is a side elevation.

Referring to FIG. 1, a mine roof support 10 comprises a base 11, a roofing bar structure 12 and an elevated, forwardly extending platform 13. The support 10 is positioned near to and facing a coal face 14, and a coal cutting machine 15 and coal conveyor 16 are shown in dotted lines at the foot of the coal face 14. An elevated platform 13 extends over the conveyor 16 and cutting machine body 15*a*. To aid stability of the support 10 the base 11 is extended forwardly at the toe 17. The roofing bar structure 12 is supported from the base 11 by extendible props 18 and also at the forward end by a further extendible prop or props 19 which is or are mounted on the elevated platform 13.

A coal face supporting sprag 20 is pivotally mounted at 21 on a ram 22 attached to the elevated platform 13 and extendible relative thereto so that the sprag 20 may be brought into contact with the coal face 14. To allow for unevenness of the coal face 14 or its non-verticality the inclination of the sprag 20 may be adjusted by means of the extendible arm 23 connected between the platform 13 and the sprag 20.

A similar sprag 24 is pivotally mounted on and depends from the roofing bar structure 12, the sprag 24 being adjustable as regards inclination by means of extendible arm 25 in like manner to sprag 20.

Figure 2:
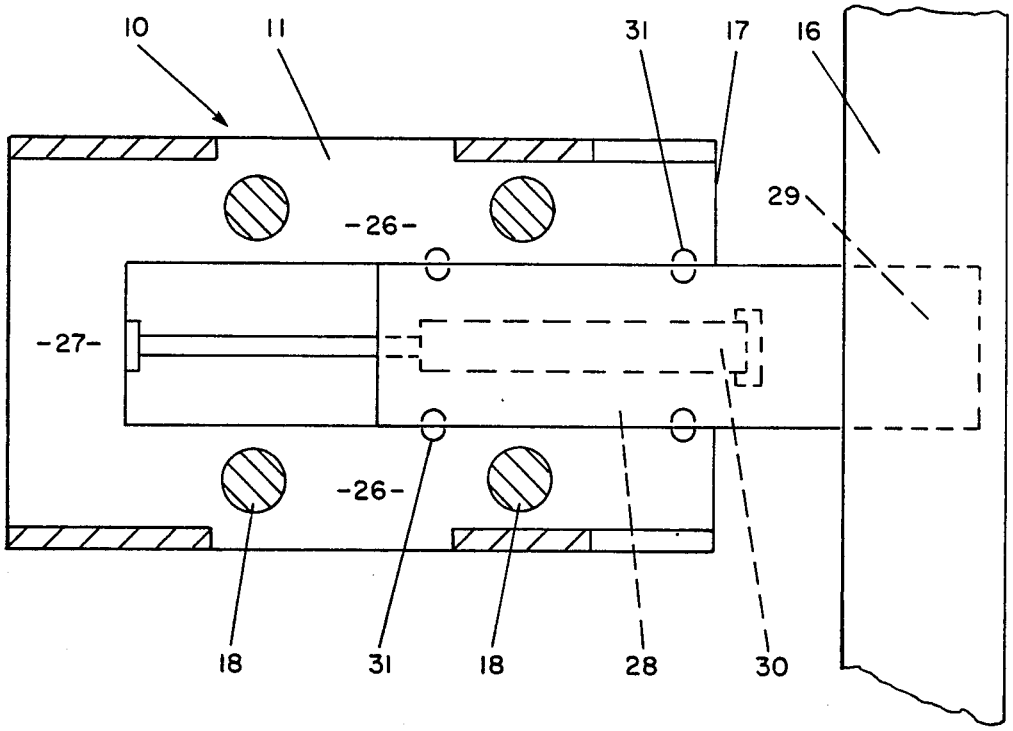

Referring now to FIG. 2 and FIG. 3 the base 11 comprises two roof supporting base members 26 which are linked by cross-beam 27 so as to be movable together. Mounted on and supported by the base members 26 are the props 18 and elevated platform 13 so that in the normal operating condition the roof is supported from the base members 26. The base 11 also comprises a beam 28 located by guides 32 (FIG. 3) between the base members 26 and carrying on its forward end 29 the conveyor 16. The base members 26 carry a plurality of vertical symmetrically disposed lifting jacks 31 the pistons of which react against beam 28. By means of these lifting jacks 31, which can be extended or retracted as required, the base members 26 may be lifted relative to the beam 28 so as to be clear of the ground or at least so as to reduce the reactive force therebetween substantially to zero. In the normal operating condition of the support 10 the lifting jacks 31 are pressurised so as to force the beam 28 downwardly relative to the base members 26 whereby the beam 28 contributes to the carrying of the load from the roof on the support 10. The cross-beam 27 is connected to the beam 28 by means of a horizontally and fore and aft disposed extendible jack 30. Extension or retraction of the jack 30 causes relative fore and aft motion between the beam 28 and the base members 26.

The operation of advancing the support 10 is as follows. From the normal operating roof supporting condition described above the lifting jacks 31 are de-pressurised so that the beam 28 is not forced into contact with the ground, they may be pressurised so that the beam is lifted clear, the roof being supported solely by the base members 26. The jack 30 is then extended to move the beam 28 forwardly relative to the remainder of the support 10, the conveyor 16 moving forwardly with the beam 28. When sufficient forward movement has been achieved the lifting jacks 31 are pressurised so as to force the beam 28 downwardly and lift the base members 26 clear of the ground. During this latter part of the operation the props 18, 19 are retracted so that the roof is not supported by the support but by adjacent supports. The jack 30 is then retracted to as to move the base members 26, and thus the support 10 forwardly up to the beam 28. The lifting jacks 31 are then pressurised so as to lower the base members 26 whilst maintaining that the beam 28 is forced downwardly relative thereto, whilst the props 18, 19 are re-extended, to restore the support 10 to the normal, roof supporting, operating condition.

Whilst base members 26 are being moved forwardly they may be completely clear of the ground or alternatively as in the case of forwardly of the relatively light beam 28, they may remain in contact with the ground so as to scrape the ground clear of loose particles or 'fines' and provide a firm base for the beam 28 or base members 26 to be set down on. In this way compaction of such fines before the full loading can be carried by the support 10 is avoided.

Also by means of the above described construction, the upper part of the coal face 14 is supported whilst cutting is performed at the lower part of the face. This support is particularly important in the case that the coal in the seam is soft and friable, when coal falls are increasingly liable to occur. In such cases the operator of the coal cutting machine will have much greater protection against falling of coal from the upper coal face than was available heretofore. Advancement of the support is also more readily achieved in such case by virtue of the avoidance of the support digging into the ground.

Clearance between the beam 28 and the base members 26 may be provided whereby the support 10 may have its alignment with the conveyor 16 and neighbouring supports adjusted during the advancement stage.

I claim:

1. A mine roof support comprising at least one elongated base member adapted to engage the floor of a mine, a beam engageable with the mine floor and being shiftable longitudinally of said base member, an abutment at one end of the beam and movable therewith relative to said base member, and means for advancing the base member relative to the beam comprising single acting ram means adapted to lift said base member relative to said beam with the beam in engagement with the mine floor, and displacement means adapted upon actuation in an appropriate sense to move said base member longitudinally of said beam when so lifted, the displacement means being operable to move the beam longitudinally of the base member when the base member and beam engage the mine floor.

2. A support according to claim 1 comprising two base members which are linked so as to be movable together.

3. A support according to claim 2 wherein said beam is located between said two base members.

4. A support according to claim 3 comprising cooperating guide means provided on each of said beam and said base members, the abutment comprising a conveyor extending transversely of the beam.

5. A support according to claim 1 wherein said lifting means comprises a plurality of extendible jacks.

6. A support according to claim 1 wherein said moving means comprises at least one extendible jack.

7. A support according to claim 1 comprising a roofing bar structure, and means coupling said bar structure to said base member.

8. A support according to claim 7 said coupling means comprising extendible props or jacks adapted to support said roofing bar structure from said base member or members.

9. A support according to claim 7 comprising a coal face support sprag pivotally attached to said roofing bar structure to depend therefrom.

10. A support according to claim 9 comprising jack means adapted to adjust the inclination of said sprag.

11. A support according to claim 7 comprising an elevated platform intermediate said base member and said roofing bar structure.

12. A support according to claim 11 comprising a coal face support sprag pivotally mounted on said elevated platform to extend upwardly therefrom.

13. A support according to claim 12 comprising jack means adapted to move said platform mounted sprag forwardly and rearwardly relative to said platform.

14. A support according to claim 12 comprising jack means adapted to adjust the inclination of said platform mounted sprag.

15. In a mine roof support including a roofing bar structure, an elongated, mine-floor engaging base member, and extensible props supporting the roof bar structure from the base member, a roof support advancing means comprising: a beam engageable with the mine floor adjacent to said base member, displacement means extending between and connected with the beam and base member and adapted upon actuation to effect relative longitudinal movement therebetween, and single-acting jack means operable between the beam and base member and adapted upon actuation, when the beam is in engagement with the mine floor, to lift the base member relative to the beam and permit longitudinal movement of said base member relative to the beam upon actuation of the displacement means in an appropriate sense, said jack means being operable to permit movement of the beam relative to the base member by the displacement means in the support mode of the mine roof support.

16. In a mine roof support as set forth in claim 15, wherein the jack means is adapted selectively to transmit a part of the loading applied to the base member to the beam.

17. In a mine roof support as set forth in claim 15, wherein the jack means is mounted on the base member and is adapted to bear downwardly on the beam, the base member being supported on the beam through said jack means when raised for longitudinal displacement and the jack means being in sliding contact with the beam during such displacement.

* * * * *